United States Patent [19]

Kumata et al.

[11] Patent Number: 4,986,718

[45] Date of Patent: Jan. 22, 1991

[54] METHOD AND APPARATUS FOR SUPPLYING ROD-LIKE ARTICLES

[75] Inventors: Katsuhiko Kumata; Isao Endo; both of Chiba; Hitoshi Tachikawa, Tokyo, all of Japan

[73] Assignees: Japan Tobacco Inc.; Tokyo Automatic Machinery Works, Ltd., both of Tokyo, Japan

[21] Appl. No.: 320,627

[22] Filed: Mar. 8, 1989

[30] Foreign Application Priority Data

Mar. 18, 1988 [JP] Japan ..... 63-66955

[51] Int. Cl.[5] ..... B65G 1/08

[52] U.S. Cl. ..... 414/421; 414/420; 414/422; 414/414; 414/786

[58] Field of Search ..... 414/403, 404, 414, 419, 414/420, 421, 422

[56] References Cited

U.S. PATENT DOCUMENTS

| | | | |
|---|---|---|---|
| 2,799,413 | 7/1957 | Innocenti | 414/403 X |
| 3,283,930 | 11/1966 | Cascio et al. | 414/403 X |
| 3,332,560 | 7/1967 | Niepmann | 414/403 X |
| 3,486,647 | 12/1969 | Seragnoli | 414/419 X |
| 3,655,080 | 4/1972 | Gianese | 414/421 X |
| 3,672,522 | 6/1972 | Wahle et al. | 414/421 |
| 3,703,242 | 11/1972 | Marradi | 414/421 X |
| 3,718,224 | 2/1973 | Hillman | 414/419 |
| 3,883,017 | 5/1975 | Shirai et al. | 414/421 X |
| 4,269,559 | 5/1981 | Focke | 414/421 X |
| 4,278,385 | 7/1981 | Bardenhagen et al. | 414/419 |
| 4,366,895 | 1/1983 | Bennett et al. | 414/421 X |
| 4,403,908 | 9/1983 | Cartoceti | 414/403 X |
| 4,696,617 | 9/1987 | Kumata et al. | 414/422 |

FOREIGN PATENT DOCUMENTS 60-240628 11/1985 Japan .

*Primary Examiner*—Frank E. Werner
*Assistant Examiner*—John VandenBosche
*Attorney, Agent, or Firm*—Sandler, Greenblum & Bernstein

[57] ABSTRACT

Method and apparatus for supplying rod-like articles, such as cigarettes, cigars, filter plugs, and tampons. A group of such articles is moved from a receiving location to a discharging location in a predetermined configuration within a storage container. At the discharging location, the container is inverted so that its open side faces downwardly to thereby discharge the articles therefrom. Concurrently with the discharge, the container is lifted from the support surface and containing plates are raised to engage the articles. The distance between the plates is substantially the same as the distance between a respective pair of inner side walls of the container so that the articles are substantially maintained in the predetermined configuration upon the retraction of the container. In one embodiment, the plates are movable vertically and advance the articles a predetermined amount along the supply passage until they abut a shutter mechanism which blocks further advancement. In a second embodiment, the containing plates engage the articles on a support surface located along side of the supply passage and a pusher mechanism shifts the articles onto the supply passage to a position adjacent the shutter mechanism. In both embodiments, once the articles have been located adjacent the shutter mechanism, the plates are withdrawn as a feeding mechanism located upstream along the supply passage engages a rear surface of the articles to thereby advance the articles along the supply passage following the opening of the shutter mechanism. The articles then are advanced in the direction of a storage device.

60 Claims, 10 Drawing Sheets

METHOD AND APPARATUS FOR SUPPLYING ROD-LIKE ARTICLES

BACKGROUND OF THE INVENTION

1. Field of the Invention

This invention relates to a method and apparatus for supplying rod-like articles, such as cigars, cigarettes, filter plugs, tampons or the like. More particularly, the invention relates to a system in which the rod-like articles are maintained in substantially the same orientation during transport in a rod-like article storing box having an open upper surface, as well as after they are discharged therefrom to a supply passage, without changing their orientation.

2. Description of Background and Pertinent Information

The conventional system for supplying rod-like articles is disclosed, for example, in Japanese Patent Laid-Open Application No. 60-240628. That system includes a method and apparatus for supplying rod-like articles, wherein a rod-like article supplying passage is arranged at an inlet end of a storing device. A rod-like article storing box is arranged in an inverted condition upon the supplying passage by means of a box distributing mechanism. Thereafter, the storing box is pulled upwardly by the box lifting mechanism of the box distributing mechanism. The group of rod-like articles in the storing box is intended to be supplied onto the supplying passage without changing its stacked condition and, at the same time, the rod-like articles in one box are all transported by the pusher mechanism as they are piled in a direction perpendicular to a longitudinal direction of the rod-like articles, and transported into the storing device. The lifted empty storing box is discharged from the supplying passage by an empty box discharging mechanism.

3. Problems Solved by the Invention

Problems are presented, however, in the conventional type of rod-like article supplying method and apparatus. Specifically, a difference in size exists between the inner dimension of the storing box and the inner dimension of the guide for holding the box, so as to move the box up and down, when there is a handle or a projection such as reinforcing member or the like on the outer surface of the storing box, due to the fact that the storing box held in its inverted condition with the box distributing mechanism is raised by the box lifting mechanism in an attempt to remove the rod-like articles from the box without changing its piled-up condition. Further, when the storing box is lifted, the rod-like articles tend to roll out of the box, causing a disturbance in the attitude of the rod-like articles and, at the same time, the stable transportation of the articles can not be effectively performed with a pusher mechanism and, in fact, the storing box is limited to one having a thin wall thickness and having no projection on its outer surface.

Since the storing box after emptying could not be returned to the box distributing mechanism without disturbing the removed rod-like articles, in the prior apparatus it was necessary to provide an empty box discharging mechanism for discharging the empty box from the supplying passage. Consequently, the device became complicated and the entire device became large in size.

SUMMARY OF THE INVENTION

An object of the present invention, therefore, is to overcome the aforementioned problems presented by the prior apparatus. The apparatus of the present invention includes:

a supply passage along which the articles are transported in a predetermined direction;

a container distributing mechanism for holding a container for containing the articles in a predetermined configuration having a forward end and a rearward end, the configuration being determined by the interior dimensions of the container; the container distributing mechanism further includes an inverting device attached to a transporting device for moving the container between a feeding position and a discharging position adjacent the supply passage, the container being inverted in the discharging position; and a containing mechanism having predetermined dimensions for containing the articles in the predetermined configuration at the discharging position and for permitting the container to be returned to the feeding position, the containing mechanism comprising a lateral feeding mechanism located adjacent the supply passage upstream of the rearward end of the configuration in the predetermined direction of movement of the supply conveyor for moving the articles in the predetermined direction of movement of the supply passage.

In a further aspect of the invention, a transporting mechanism is provided for moving containers into the feeding position. The transporting mechanism can include a pusher for pushing the containers into the feeding position. The transporting mechanism can further include an engaging claw mounted for movement on the pusher for engagement with and disengagement from a hook element of the container.

In a further aspect of the invention, the inverting device includes an upwardly facing open side in the feeding position, and a selectively actuable lid extending over at least a portion of the open side.

According to a further aspect of the invention, the transporting device is configured to move the inverting device sequentially from the feeding position upwardly to an upper extreme position and downwardly therefrom, such that the open side is downwardly facing, to the discharging position.

According to a still further aspect of the invention, the containing mechanism includes a partition mechanism including forward and rearward partition plates for containing the articles against substantial downstream and upstream movement, respectively, with regard to the supply passage. A driven member is further provided for connecting the forward and rearward partition plates which is adapted to support the articles discharged at the discharging position. The driven member further includes, in one embodiment, a receiving surface for supporting the articles and movable between a supporting position slightly above an upper surface of the supply passage and a retracted position in which the forward and rearward partition plates are below the upper surface of the supply passage. A first drive apparatus is further provided to move the driven member in a substantially vertical direction between the supporting position and the retracted position. Further, a second drive apparatus operatively associated with the driven member is provided to move the driven member substantially in the predetermined direction of the supply passage from a receiving position to an advanced position proximate the forward partition plate of the partition mechanism.

According to a still further aspect of the invention, the containing mechanism further includes at least one selectively movable side plate positioned along side the supply passage.

According to a still further aspect of the invention, a shutter mechanism is located along the supply passage downstream of the forward end of the predetermined configuration in the predetermined direction of the supply passage, in the discharging position, for blocking advancement of the articles along the supply passage. The shutter mechanism includes a shutter plate mounted on either side of the supply passage for reciprocation between a closed position in which the shutter plates are spaced apart a distance less than the length of one the rod-like articles and an open position in which the shutter plates are spaced apart a distance greater than the length of one of the rod-like articles.

According to a still further aspect of the invention, the supply passage includes a supply conveyor, and further includes a drive apparatus for driving the supply conveyor, a drive apparatus for driving the lateral feeding mechanism, and an apparatus for driving the supply conveyor and the lateral feeding mechanism at substantially the same speed. The drive apparatus for the lateral feeding mechanism and the drive apparatus for the supply conveyor can share a common drive motor. Further, the drive apparatus for the supply conveyor can include a clutch to stop movement of the supply conveyor during predetermined times. Further, the lateral feeding mechanism includes a reciprocal member for advancing the articles in the direction of movement of the supply conveyor and wherein the predetermined times at which the clutch stops movement of the supply conveyor occur during retraction of the reciprocal member in a direction substantially opposite to the direction of movement of the supply conveyor.

According to a still further aspect of the invention, the articles are rod-like articles having a predetermined length and the lateral feeding mechanism includes a lateral feeding plate for engaging the rearward end of the configuration of the rod-like articles, having a width transverse to the predetermined direction of the supply passage less than the length of one of the rod-like articles.

According to a still further aspect of the invention, the supply passage includes a plurality of side-by-side conveying elements, at least two of which are spaced apart a predetermined amount, wherein the containing mechanism includes a partition mechanism which includes an upwardly projecting forward partition member for engaging a downstream end of the predetermined configuration of articles, an upwardly projecting rearward partition member for engaging an upstream end of the predetermined configuration of articles, and a laterally extending driven member having an upper support surface for the rod-like articles, the driven member connecting the forward partition member and the rearward partition member at respective lower ends of the partition members, the partition mechanism being operable to move between a retracted position beneath an upper surface of the supply passage to a support position wherein the forward partition member, the rearward partition member, and the upper support surface of the driven member are extended between two of the plurality of side-by-side conveying elements to contain the rod-like articles in substantially the predetermined configuration.

According to a still further aspect of the invention, the partition mechanism is operable to move the rod-like articles in substantially the predetermined configuration in substantially the predetermined direction of the supply passage. A shutter mechanism is located along the supply passage downstream of the forward end of the predetermined configuration in the predetermined direction of the supply passage, in the discharge position, wherein the partition mechanism is operable to move the rod-like articles to a position substantially adjacent the shutter mechanism, whereby the shutter mechanism blocks movement of the rod-like articles in the predetermined direction of the supply passage. Further, the conveying elements are driven for movement, and the shutter mechanism is movable between a blocking position and an open position, and in the open position the feeding mechanism and the conveying elements move substantially at the same speed in the predetermined direction to advance the rod-like articles from the discharge position.

According to a still further aspect of the invention, a storage device communicates with the supply passage downstream of the discharging position of the rod-like articles such that the rod-like articles are advanced toward the storage device.

According to a still further aspect of the invention, the rearward partition member includes a pair of rearward partition plates spaced apart a distance greater than the width of the lateral feeding plate to permit the lateral feeding plate to extend between the pair of rearward partition plates to engage the rearward end of the predetermined configuration of articles.

According to another embodiment of the invention, a relatively stationary receiving surface is provided for receiving the articles in the predetermined configuration at the discharging position, and a transfer mechanism for transferring the articles in the predetermined configuration to the supply passage. The supply passage has an upper support surface and the receiving surface is substantially flush with the upper support surface, and the transfer mechanism includes a pushing mechanism for pushing the articles in the predetermined configuration across the receiving surface onto the upper support surface of the supply passage. Further, the pushing mechanism includes a pusher plate mounted for movement across the receiving surface as the articles are pushed across the receiving surface to a position along side of the supply passage to thereby function as a guide as the articles in the predetermined configuration are moved along the supply passage in the predetermined direction, and a side wall plate is positioned along an opposite side of the supply passage from the pusher plate. The side wall plate is mounted for movement in conjunction with and at substantially the same speed as the pusher plate of the transfer mechanism to maintain a spacing therebetween slightly wider than the length of one of the articles to maintain the articles in the predetermined configuration during transfer.

The apparatus of the invention for conveying articles can be further defined as including:

(a) a supply passage along which the articles are conveyed in a first direction;

(b) means for (i) receiving a group of the articles in a predetermined configuration in a storage container, (ii) moving the group of articles in the predetermined configuration in the storage container from a receiving position to a discharging position, the discharging position being proximate the supply passage, and (iii) discharging the group of articles in the predetermined configuration from the storage container at the discharging position; and (c) means for containing the group of articles substantially in the predetermined configuration as the group of articles is discharged.

The group of articles are discrete and loose in the predetermined configuration at the discharge position, and solely the containing means contains the group of articles in the predetermined configuration. The articles are preferably rod-like articles each having longitudinal axes and wherein, in the predetermined configuration, the longitudinal axes are substantially parallel to each other, and wherein the containing means substantially prevents the rod-like articles from rolling relative to one another.

In the invention so defined, each of the articles has a substantially equal predetermined length, wherein the group of articles in the predetermined configuration has a forward end and a rearward end and a predetermined length between the forward end and the rearward end, a predetermined height, and a predetermined width, the predetermined width defined by the predetermined length of the articles, and wherein the containing means includes a forward member for containing the forward end of the group of articles and a rearward member for containing the rearward end of the group of articles.

In the receiving position, the container has an upwardly facing opening, and the means for (i) receiving, (ii) moving, and (iii) discharging further includes means for (iv) inverting the storage container to thereby direct the upwardly facing opening downwardly and for (v) releasing the group of articles from the storage container and withdrawing the storage container from the discharging position in a predetermined direction.

The invention further includes means for moving the forward member and the rearward member of the containing means in the predetermined direction in which the storage container is withdrawn as the storage container is withdrawn. The container is preferably withdrawn upwardly.

In the invention, the supply passage has a support surface, the forward member and the rearward member of the containing means are mounted for movement from below the support surface to above the support surface, and the containing means further includes means for moving the articles in the first direction.

Further, the supply passage includes, in one form, a plurality of side-by-side spaced apart support surfaces and wherein the forward member and the rearward member of the containing means are arranged for movement between a pair of the support surfaces. A receiving surface is also provided for receiving the group of articles at the discharging position, the forward member and the rearward member of the containing means are movable upwardly to contain the group of articles in the predetermined configuration on the receiving surface. Further, means for transferring the group of articles in the predetermined configuration from the receiving surface to the supply passage is provided. The means for conveying includes a pusher for exerting a force against the articles. Further, the means for conveying includes a powered conveyor supporting the articles from below. Still further, a support surface is provided, across which the pusher conveys the articles.

Still further, means for blocking movement of the articles along the supply passage is provided, mounted for movement between a blocking position and an open position at which position the articles are permitted to move along the supply passage.

The method of the invention for conveying articles can be defined as:

(a) receiving a group of articles in a predetermined configuration in a storage container at a receiving location;

(b) moving the group of articles in the predetermined configuration in the storage container from the receiving location to a discharging location proximate a supply passage;

(c) discharging the group of articles from the storage container at the discharging location;

(d) containing the group of articles substantially in the predetermined configuration as the group of articles is discharged from the storage container; and (e) conveying the group of articles in a direction along the supply passage while substantially maintaining the group of articles in the predetermined configuration.

Further, according to the method of the invention, the predetermined configuration of the group of articles includes a predetermined width in the direction of the supply passage, the articles are loose within the container, and the step of containing includes maintaining the predetermined width substantially constant.

The step of conveying further includes conveying the group of rod-like articles in a direction substantially perpendicular to the lengths of the rod-like articles being conveyed.

Further according to the method of the invention, the step of moving includes inverting the storage container between the receiving location and the discharging location.

Still further, the step of discharging includes raising the inverted storage container from the discharging location to thereby empty the storage container.

Still further, the step of containing the group of articles in the predetermined configuration further includes raising a pair of partition members which are spaced apart by a distance substantially equal to a distance between a pair of inner walls of the storage container.

Still further, the method includes the steps of advancing the group of articles along the supply passage by means of the partition members to a predetermined location, blocking further advancing of the group of articles by means of a shutter mechanism, and retracting the partition members from the supply passage.

Still further, the method includes the step of opening the shutter mechanism to permit further advancing of the group of articles beyond the shutter mechanism.

Still further, the method includes the step of transferring the group of articles in the predetermined configuration substantially transversly onto the supply passage.

Still further, the method includes the step of returning the storage container, after discharging the group of articles therefrom, to the receiving location.

BRIEF DESCRIPTION OF DRAWINGS

FIG. 1 is a front elevation view partially broken away, illustrating a rod-like article supplying device of a preferred first embodiment of the invention;

FIG. 2 is a side elevation view, partially broken away;

FIG. 3 is a front elevation view illustrating a condition in which the partition plates are moved upwardly, with only substantial portions being shown;

FIG. 4 is a plan view of FIG. 3 in partial section; and

FIG. 5 is a plan view in section, illustrating a condition in which the partition plates are advanced.

FIG. 6 is a side elevation view, partially broken away, of the rod-like article supplying device, illustrating a preferred second embodiment of the invention;

FIG. 7 is an enlarged longitudinal side elevation in section illustrating a substantial part of the invention of the condition in which the partition plates are moved upwardly;

FIG. 8 is a plan view in section;

FIG. 9 is an enlarged longitudinal side elevation view, illustrating a substantial part of the invention of the condition in which the rod-like article group is transported onto the supplying passage with the pusher; and FIG. 10 is a plan view in section.

DESCRIPTION OF PREFERRED EMBODIMENTS

Figure 1:
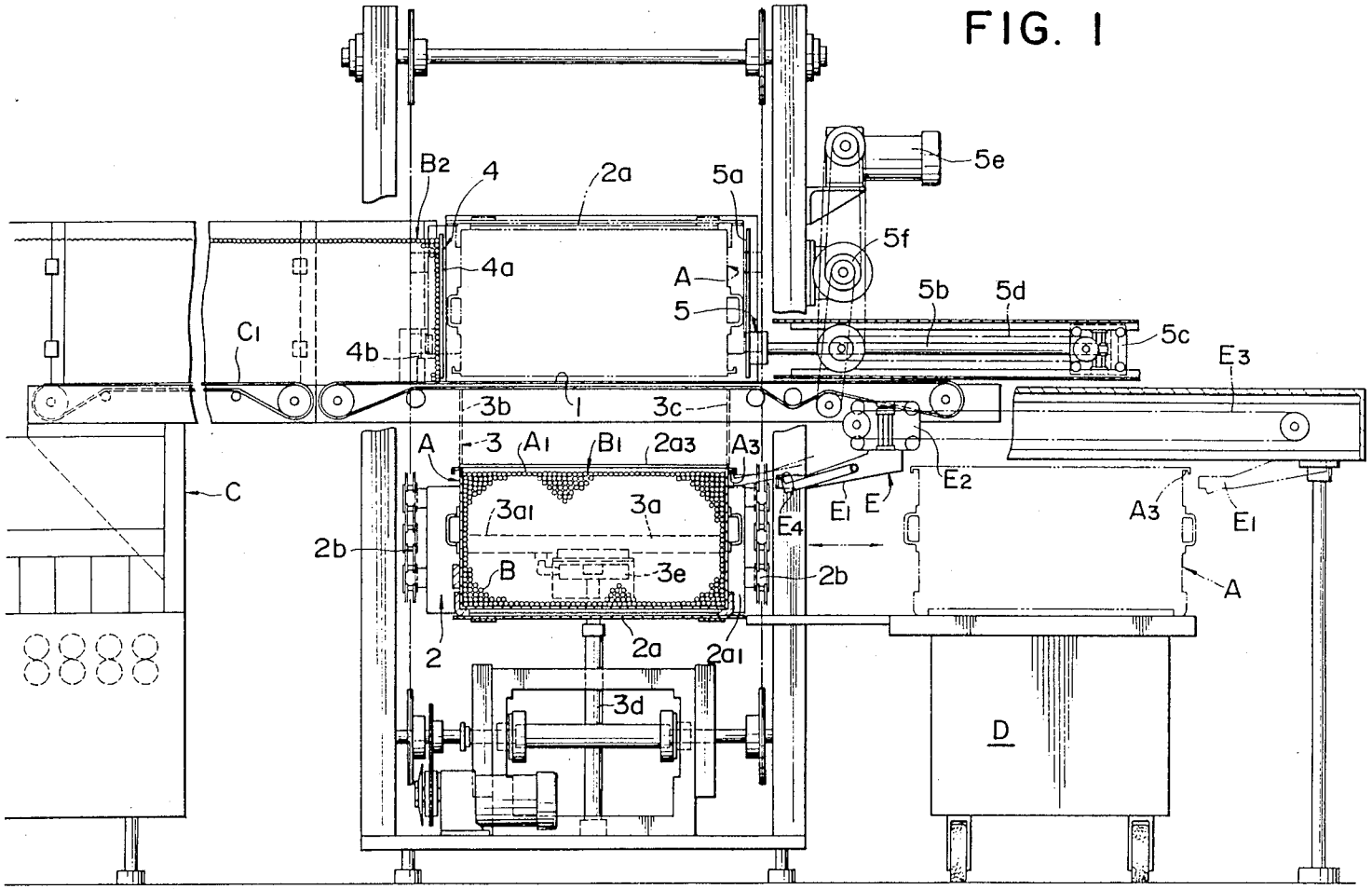
FIGS. 1–5 illustrate a first embodiment of the invention.
Figure 2:
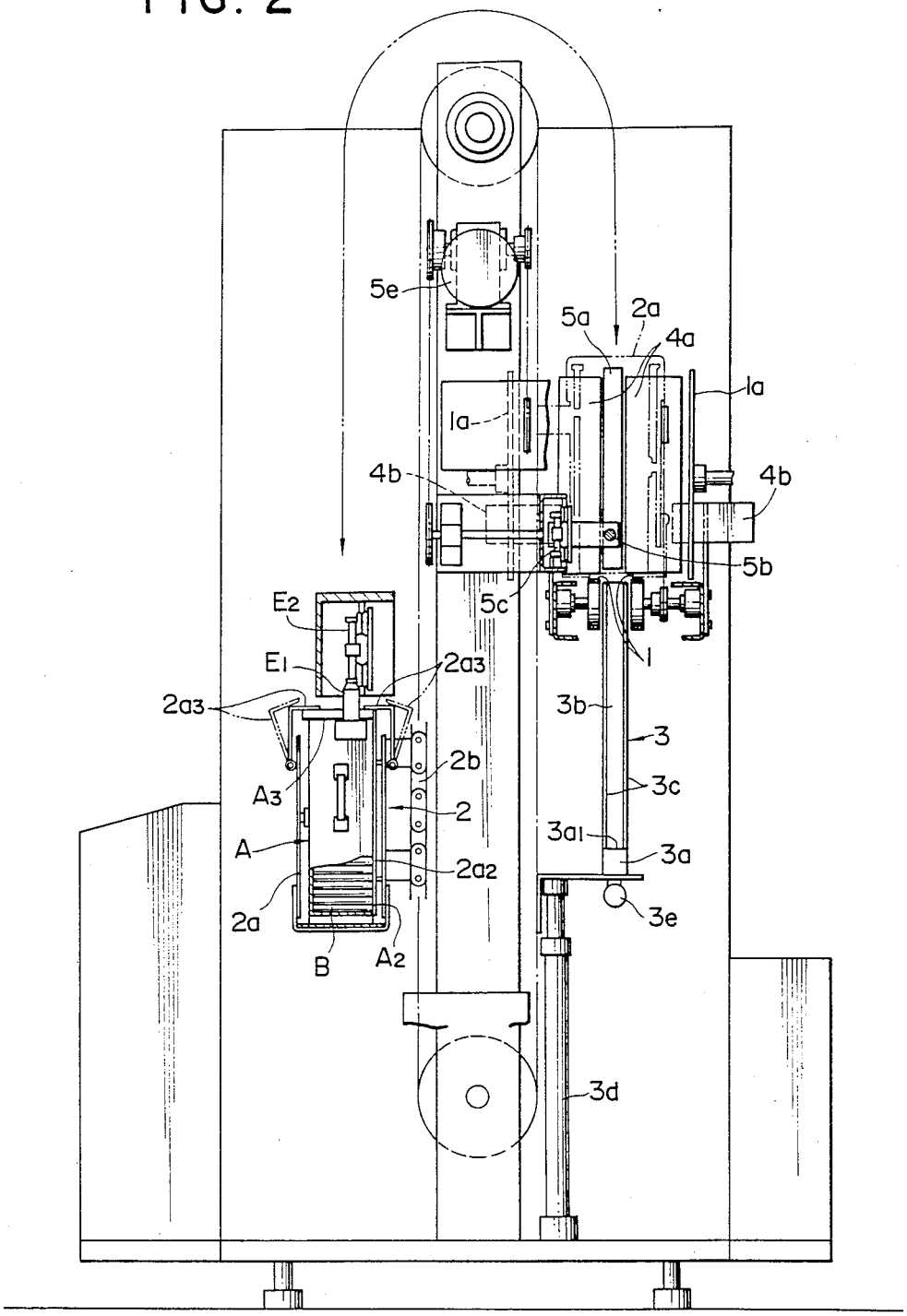
Figure 3:
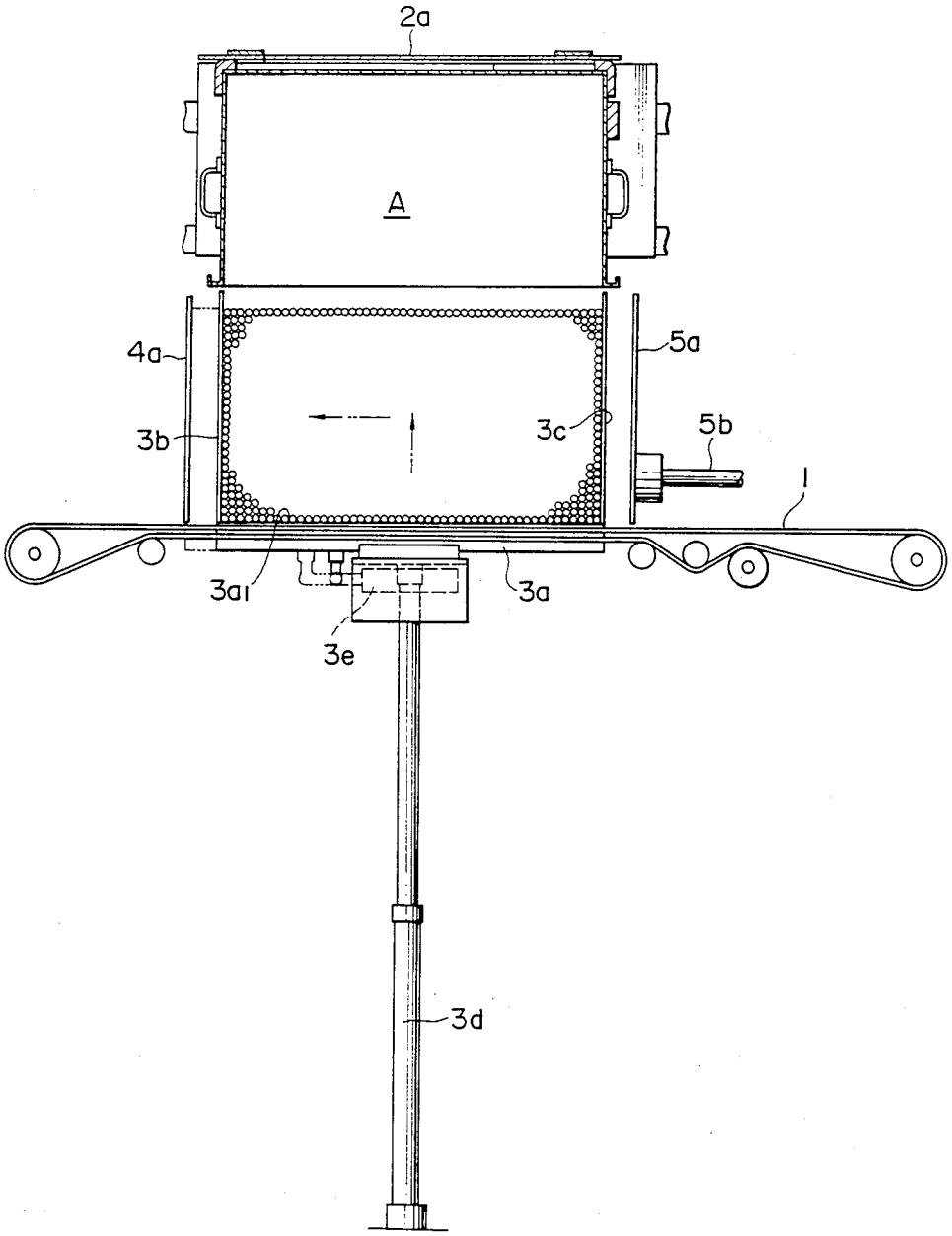

In view of the problems in prior apparatus as described above, it is an object of the present invention to remove the rod-like article from the storing box from its inverted position at a discharging location without changing the predetermined configuration of the articles as contained within the storing box; to enable the storing box to be used without any regard as to the presence or absence of any projection elements at the outer surface; and, at the same time, to enable the empty storing box to be returned.

The method of the first embodiment of invention is characterized in that a rod-like article storing box with its top surface being open is inverted by being transported to the inverted position and transported, in this inverted position, in a substantially vertical direction, being supplied to a rod-like article supplying passage communicating with a storing device through a shutter plate which can be opened or closed. A pair of front and rear partition plates are lifted in cooperation with the returning and lifting of the storing box to support a group of rod-like articles discharged from the box without substantially varying the piled-up condition, i.e., the predetermined configuration. Thereafter, the front and rear partition plates are moved, laterally in a forward supplying direction by a desired and predetermined distance to cause the front end surfaces of the group of rod-like articles to be adjacent a shutter plate mechanism. A lateral transmitting pusher is advanced by a desired and predetermined distance against the rear end surface of the group of the rod-like articles. Thereafter, the front and rear partition plates are lower and, at the same time, the shutter plate is opened to cause the rod-like articles on the supplying passage to be moved in such a direction substantially perpendicular to the longitudinal direction of the rod-like articles and transported into the storing device.

The apparatus of the first embodiment of the invention is characterized in that a rod-like article supplying passage communicating with an inlet end of a storing device extends laterally, a box distributing mechanism for reversing and transferring a rod-like article storing box, with its upper surface being opened, is slidably moved in an upside down U-shaped structure in a direction substantially perpendicular to the feeding direction from a feeding position to a discharge position, and a partition mechanism having a front and rear partition plate is positioned at the discharge position to be substantially flush with each of the front and rear inner surfaces of the box. The apparatus further includes a shutter mechanism which can be opened or closed in a direction substantially perpendicular to the supplying direction, located at a front end of the supplying direction on the supplying passage, and a lateral feeding pusher mechanism which can be reciprocated toward the shutter mechanism from the rear end of the supplying direction.

The method of the second embodiment of the invention is characterized in that a rod-like article storing box having its upper surface open is inverted by being transported to the inverted position and transported, in this inverted position, in a substantially vertical direction, being supplied to a transporting and receiving surface, which is substantially flush with a rod-like article supplying passage which communicates with a storing device and is substantially parallel with the same through a shutter plate which can be opened or closed. A pair of front and rear partition plates are lifted in cooperation with the returning and lifting movement of the storing box to cause a group of rod-like articles within the box to be supported without substantially varying their piled-up condition. Thereafter, the group of rod-like articles discharged from the box is moved substantially horizontally in a longitudinal direction of the rod-like articles by a desired and predetermined distance by means of the pusher, and supplied in such a way that the front end surface of the group of rod-like articles is close to the shutter plate and the rear end surface is close to a lateral feeding pusher, respectively, and, at the same time, the rod-like articles on the supplying passage are transported together by the lateral feeding pusher mechanism and are transported into the storing device.

The apparatus of the second embodiment of the invention is characterized in that a transporting and receiving surface substantially parallel with a rod-like article supplying passage laterally installed at an inlet end of a storing device is arranged laterally substantially flush with the supplying passage. A box distributing mechanism for reversing and transporting a rod-like article storing box with its upper end being open is reciprocably arranged in an upside-down U-shaped structure from the transporting and receiving surface to receiving position. A partition mechanism having a front and a rear partition plate installed substantially vertically is reciprocably arranged in a substantially vertical direction below the transporting and receiving surface where the storing box is supplied in its inverted condition in such a way that it is substantially flush with the front and rear inner surfaces of the box and, at the same time, a pusher slightly smaller than an inner width between the front and rear partition plates is reciprocably arranged from the transporting and receiving surface onto the supplying passage in a direction substantially perpendicular to the supplying direction. A shutter mechanism which can be opened or closed is arranged at a front end of the supplying direction on the supplying passage and a lateral feeding pusher mechanism which can be reciprocated is arranged from a rear end of the supplying direction toward the shutter mechanism.

The first embodiment of the invention is operated such that the storing box containing the rod-like articles therein is transported by the box distributing mechanism from a receiving position to the rod-like article supplying passage in a discharge position in an inverted state and held in the inverted state. Thereafter, the storing box is lifted and returned to the receiving position, and, at substantially the same time, front and rear partition plates are lifted with the lifting of the storing box. Thereby, the group of rod-like articles within the box is supported without substantially changing its predetermined configuration. Thereafter, the front and rear partition plates are laterally moved in a forward supplying direction to cause the front end surface of the group of rod-like articles to approach the shutter plate. Further, the lateral feeding pusher is advanced to approach the rear end surface of the group of rod-like articles. Thereby, the group of rod-like articles can be supported in its predetermined configuration and, thereafter, the front and rear partition plates are lowered and the group of rod-like articles is transported by the lateral pusher.

The second embodiment of the invention is operated such that the rod-like article storing box is transported by the box distributing mechanism from the receiving position and held on the transporting and receiving surface in an inverted state. Thereafter, the storing box is lifted and returned to the receiving position, and, at substantially the same time, the front and rear partition plates are lifted with the lifting of the storing box. Thereby, the group of rod-like articles within the box is supported on the transporting and receiving surface without substantially changing its predetermined configuration. The front end of the group of rod-like articles approaches the shutter plate under a pushing operation in a direction substantially perpendicular to the supplying direction of the pusher and, in turn, its rear end surface approaches the lateral feeding pusher, respectively, to move onto the supplying passage. The group of rod-like articles is then supported between the lateral pushers from the shutter plate in the predetermined configuration, and then they are transported by the lateral pushers.

The preferred embodiments of the invention will now be described with particular regard to the drawings.

As shown in FIGS. 1 to 5, the first preferred embodiment of the present invention is constructed such that a rod-like article supplying passage 1 is constituted by a pair of right and left substantially horizontal and substantially parallel endless belt conveyors communicating downstream with a belt conveyor $C_1$ which constitutes a movable floor of a storing device C. Further, a box distributing mechanism 2 and supporting framework is arranged substantially perpendicularly to the supplying passage 1.

The box distributing mechanism 2 includes a reversing frame 2*a*, containing a rod-like article storing box A, and a pair of conveyor chains 2*b*, 2*b* connected to both side surfaces of the reversing frame 2*a* for reciprocating the frame by a desired amount in a substantially vertical direction and a direction substantially perpendicular to the supplying direction. The conveyor chains 2*b*, 2*b* are driven by a drive motor and associated apparatus shown in FIG. 1 at the bottom of the supporting framework to cause the reversing frame 2*a* to be lifted from a feeding, or receiving, position to an upper limit position where it is caused to be inverted and then descended while being in the inverted or reversed condition. It is stopped at a position slightly above the supplying passage 1 and then held.

The rod-like article storing box A is formed from metal, such as aluminum, or from synthetic resin. Openings $A_1$ and $A_2$ in box A are formed at the upper surface and longitudinal side surface, respectively. Inverted L-shaped hooks $A_3$ project from the upper end of one of the short sides. A quantity of rod-like article B, such as cigars, cigarettes, filter plugs, or tampons, are arranged to be piled up in such a way such that they are longitudinally directed, or face the longer sides of the storing box A, in a predetermined configuration.

The reversing frame 2*a* is box-shaped and has an internal size slightly larger than the external size of the storing box A. An opening $2a_1$ is formed at one side surface of short length and the storing box A is fed in or fed out through this opening $2a_1$. A pushing plate $2a_2$ abuts against the opening side surface $A_2$ of the storing box A and is arranged at one longitudinal side inner surface. Its upper surface is open and a pair of opening or closing lids $2a_3$, relationship. Each lid can be pivotally mounted around a respective pivot pin from a closed position to an open position shown in solid lines and phantom lines, respectively, in FIG. 2.

Both opening or closing lids $2a_3$, $2a_3$ are biased in a closing direction by a resilient member, such as a spring or the like, which can take the form of a coil spring wound around each pivot pin, for example.

When the reversing frame 2*a* is moved by the conveyor chains 2*b*, 2*b*, the upper surface opening $A_1$ of the storing box A is closed to prevent the rod-like articles B from being moved therefrom. However, when the reversing frame 2*a* is placed at the feeding position and when the reversing frame is inverted at its upper limit position and then held at the inverted position during which the upper portion of the partition mechanism 3 is positioned below the supplying passage 1, it is mechanically opened or is opened by means of an air cylinder and the like. For example, such air cylinders can be mounted directly on the reversing frame 2*a* for opening respective lids. Alternatively, abutment members fixed to the framework support chains 2*b*, 2*b* for movement therewith can be mounted for engagement with respective cooperating members for lids $2a_3$, $2a_3$ to open the lids as the reversing frame reaches the discharging, inverted, position.

Each of the right and left sides of the supplying passage 1 is provided with a side wall 1*a*, comprised of a transparent plate. The right and left side walls 1*a*, 1*a* are movably supported in a direction substantially perpendicular to the supplying direction with an air cylinder or the like. When the reversing frame 2*a* is placed on the supplying passage 1 under operation of the box distributing mechanism 2, side walls 1*a*, 1*a* are opened so as not to hinder the opening or closing operation of the opening or closing lids $2a_3$, $2a_3$. However, substantially simultaneous with the returning movement of the storing box A, they are closed so that the spacing therebetween is slightly greater than the length of the rod-like articles B.

A partition mechanism 3 is comprised of a driven member 3*a* laterally arranged in a supplying direction between the two belt conveyors constituting the supplying passage 1, a front partition plate 3*b* substantially vertically positioned in front of the driven member 3*a*, a pair of right and left rear partition plates 3*c*, 3*c* substantially vertically arranged at the rear part of the driven member 3*a*, an air cylinder 3*d* for use in performing a substantially vertical movement cooperatively arranged below the driven member 3*a*, and an air cylinder 3*e* for use in performing a selective forward or rearward movement. The forward to rearward inner width between the forward and rearward partition plates 3*b* and 3*c*, 3*c* is substantially the same as the longitudinal inner width of storing box A and the height of the forward or rearward partition plates 3*b* and 3*c*, 3*c* are substantially the same as the inner height from the upper surface of the driven member 3*a* to the opposite side of storing box A.

The driven member 3*a* forms a substantially horizontal receiving surface $3a_1$ on its upper surface. At the upper limit position of the driven member 3*a* where the rod of the air cylinder 3*d* for use in performing the substantially vertical movement, the receiving surface $3a_1$ is projected slightly above the upper surface of the supplying passage 1. At the lower limit position where the rod is moved downwardly, the upper ends of the forward or rearward partition plates 3*b* and 3*c*, 3*c* are lower than the upper surface of the supplying passage 1. At the rearward limit position of the driven member 3*a* where the rod of the air cylinder 3*e* for use in performing a forward or rearward movement is moved rearwardly in the supplying direction, the forward and rearward inner surfaces of the forward or rearward partition plates 3*b* and 3*c*, 3*c* are arranged on the supplying passage 1 to be substantially flush, respectively, with the forward and rearward inner surfaces of the storing box in its inverted condition in a substantially vertical direction. At the forward limit position of the driven member 3*a* where the rod is moved forwardly in the supplying direction, the front surface of the forward partition plate 3*b* advances as much as possible toward the forward end of the supplying passage 1 in the supplying direction, i.e., adjacent the right and left shutter plates 4*a*, 4*a* of the shutter mechanism 4 arranged at the storing device C, or it is fitted into the space between the shutter plates 4*a*, 4*a*.

The right and left shutter plates 4*a*, 4*a* are about the same size as or greater than the inner height of the storing box A and extend in a substantially vertical direction. The shutter mechanism further includes air cylinders 4*b*, 4*b* for reciprocating the right and left shutter plates 4*a*, 4*a* in a direction substantially perpendicular to the supplying direction. The spacing between the right and left shutter plates 4*a*, 4*a* is greater than the lateral width of the forward partition plate 3*b* and less than the length of the rod-like article B when closed, and is slightly greater than the length of the rod-like article B when opened.

The right and left shutter plates 4*a*, 4*a* are spaced from the reversing frame 2*a* when the reversing frame is reversed and moved on the supplying passage 1 to thereby not hinder its movement. At the rear end of the supplying direction of the supplying passage 1 the lateral feeding pusher mechanism 5 is arranged and also spaced from the reversing and transporting operation of the reversing frame 2*a*.

The lateral pusher mechanism 5 is comprised of a lateral feeding plate 5*a* having a lateral width slightly less than the lateral width between the right and left partition plates 3*c*, 3*c* of the partition mechanism 3 and has a height about the same as or slightly greater than the inner height of the storing box A, extending from slightly above the receiving surface $3a_1$ at the upper limit position. The lateral pusher mechanism 5 also includes a reciprocating device for use in reciprocating the lateral feeding plate 5*a* in the supplying direction. In the preferred embodiment of the present invention, this reciprocating means includes a cooperating arm 5*b* at the rear surface of the lateral feeding plate 5*a* and a slider 5*c* cooperatively arranged at the extreme end of the cooperating arm 5*b*. The slider 5*c* and arm 5*b* are reciprocated along the supplying passage 1 by the chain 5*d* by a predetermined amount.

Through the above-mentioned arrangement of the reciprocating means 5b, 5*c*, and 5*d*, the lateral feeding plate 5*a* is located in a position not hindering the reversing and transporting operation of the reversing frame 2*a*. At its retracted position, the front surface of the plate is passed between the right and left shutter plates 4*a*, 4*a* and at its forward limit position, its front surface slightly enters into the storing device C.

In the preferred embodiment of the present invention, a motor 5*e* for driving chain 5*d* of the lateral feeding pusher mechanism 5 is also operatively connected to a driving mechanism for the belt conveyor for the supplying passage 1. Thereby, these two elements are operated at substantially the same speed. A clutch 5*f* is placed between the belt conveyor of the supplying passage 1 and the motor 5*e*, the clutch 5*f* being operated when the lateral feeding plate 5*a* is retracted in a rearward supplying direction so as to cut off the transmission from the motor 5*e* so that the belt conveyor of the supplying passage 1 is prevented from being operated.

At the side of the feeding or receiving position of the box distributing mechanism 2 a transporting carriage D is located having a plurality of storing boxes A arranged in parallel form. The storing boxes A are fed in or fed out, one-by-one, between the carriage D and the feeding position by the transporting mechanism E from above the carriage D to above the feeding position.

The transporting mechanism E includes a pusher $E_1$ having its extreme end projected to the side of the storing box A and a slider $E_2$ cooperatively arranged at the base end of the pusher $E_1$, as well as a chain $E_3$ connected to the slider $E_2$ for reciprocating the slider in a substantially horizontal direction in a desired and predetermined amount. An engaging claw $E_4$ at the extreme end of the pusher $E_1$ is removably engaged with the hook element $A_3$ at the outer surface of the storing box A. As shown, engaging claw $E_4$ is preferably formed at the end of an arm which is mounted for selective pivotal movement to move claw $E_4$ to be engaged and disengaged with hook element $A_3$. The pusher $E_1$ is advanced while engaging claw $E_4$ is engaged with the hook element $A_3$ to thereby move the storing box A to the feeding or receiving position. The pusher $E_1$ is then retracted while being engaged with hook element $A_3$ so that the storing box A is pulled from its feeding position, thereby moving the storing box A onto the carriage D.

The sequential operation of the first embodiment will now be described.

The storing box A containing a quantity of rod-like articles B in a predetermined configuration in a piled-up form is pushed from the carriage D under advancement of the pusher $E_1$ of the transporting mechanism E into the reversing frame 2*a* waiting at the feeding position of the box distributing mechanism 2, i.e., at its lower position. Thereafter, the pusher $E_1$ releases the engaged condition between the engaging claw $E_4$ and the hook element $A_3$ of the storing box A by moving the arm carrying claw $E_4$ downwardly. Pusher $E_1$ is then retracted to the position where it does not hinder the lifting or descending of the reversing frame 2a.

When the storing box A is transported into the reversing frame 2a, the reversing frame 2a is lifted from the feeding position, shown in solid lines in FIG. 1, under the driving operation of the conveyor chains 2b, 2b. In the preferred embodiment, the opening and closing lids $2a_3$, $2a_3$ are biased closed by means of resilient elements during this lifting movement. The reversing frame 2a then reaches the upper limit position, and then descends, thereby inverting the storing box A. It is then stopped slightly above the two conveyor belts of supplying passage 1, as shown in phantom lines in FIGS. 1 and 2. After it is confirmed that the movement of the reversing frame 2a is completely stopped, the opening and closing lids $2a_3$, $2a_3$ are opened by means of a selective actuating device, acting against the resilient biasing elements.

Figure 4:
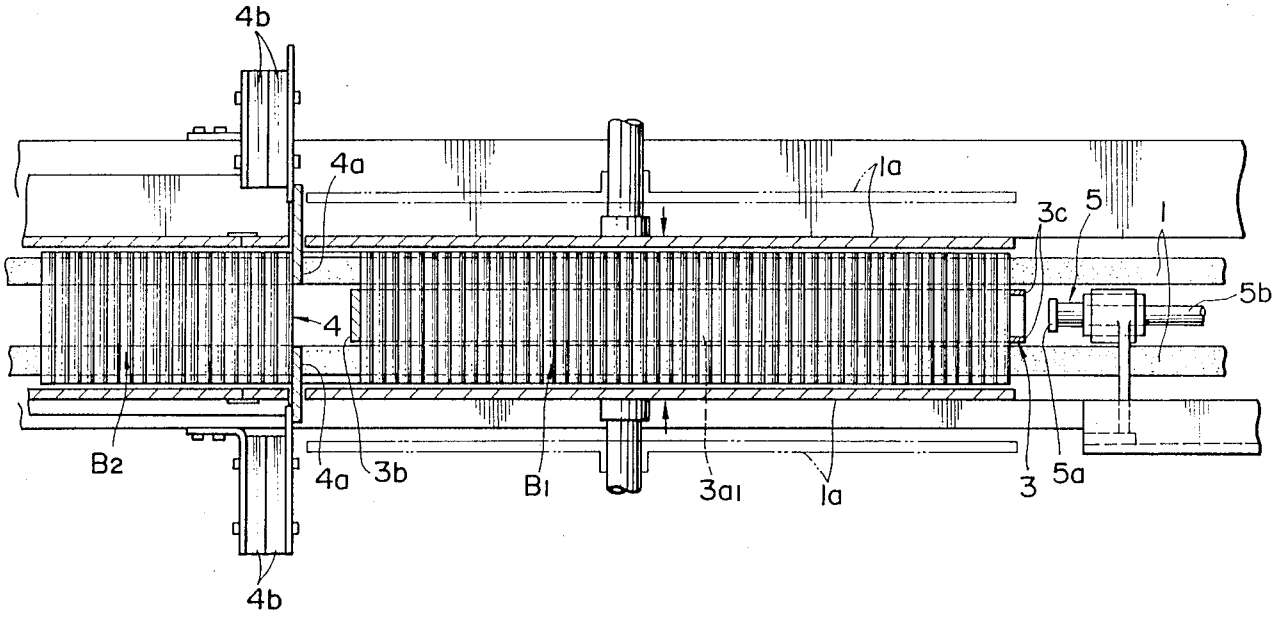
Figure 5:
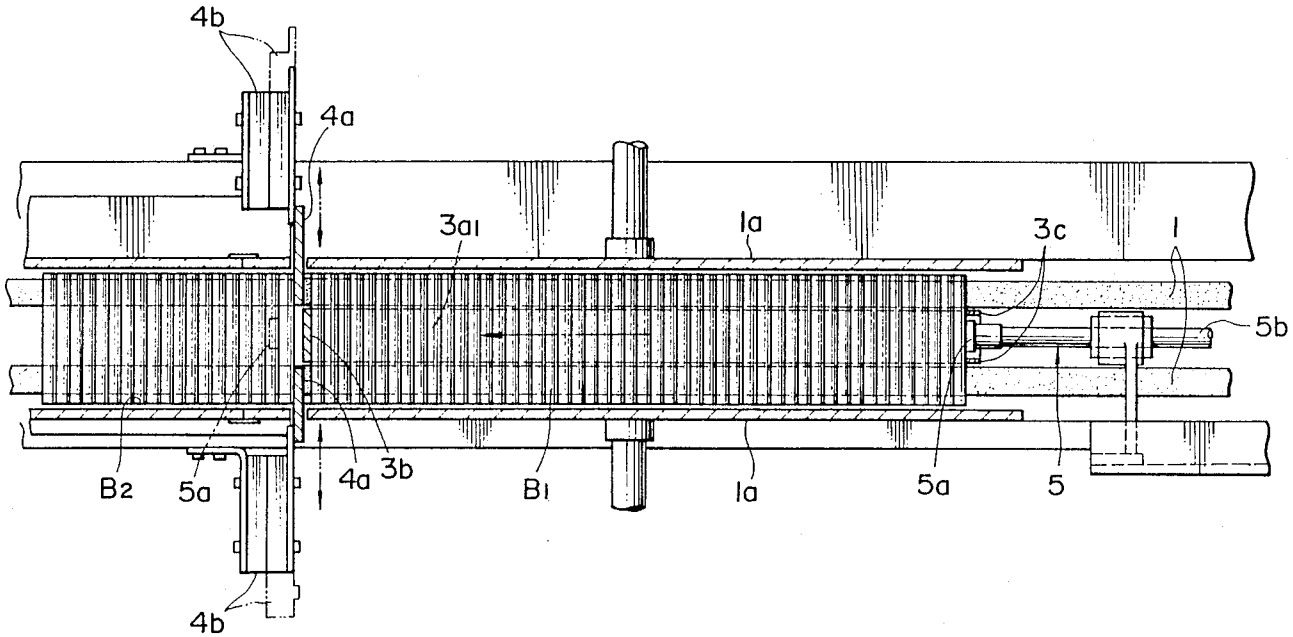
Figure 6:
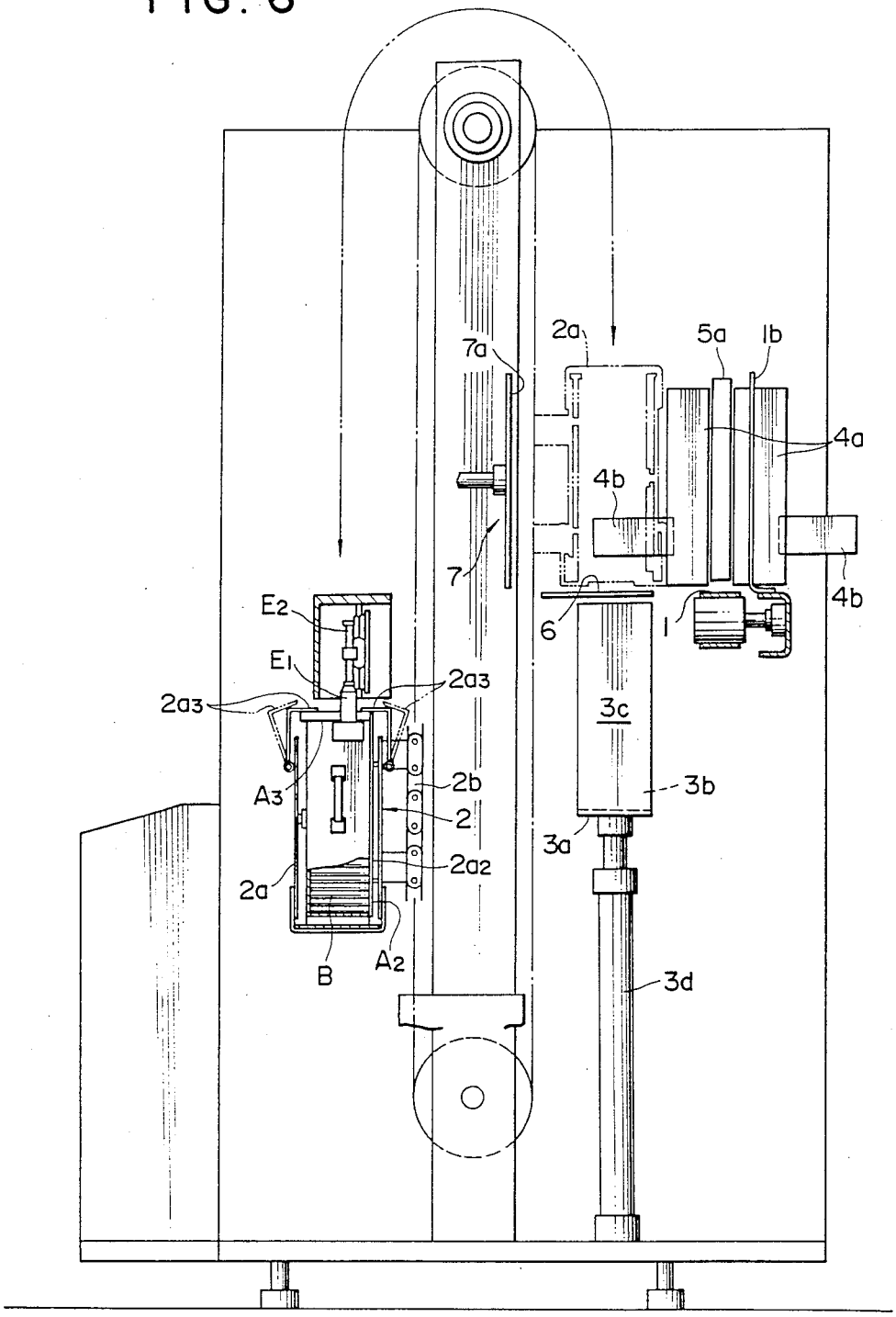
FIGS. 6–10 illustrate a second embodiment of the invention.
Figure 7:
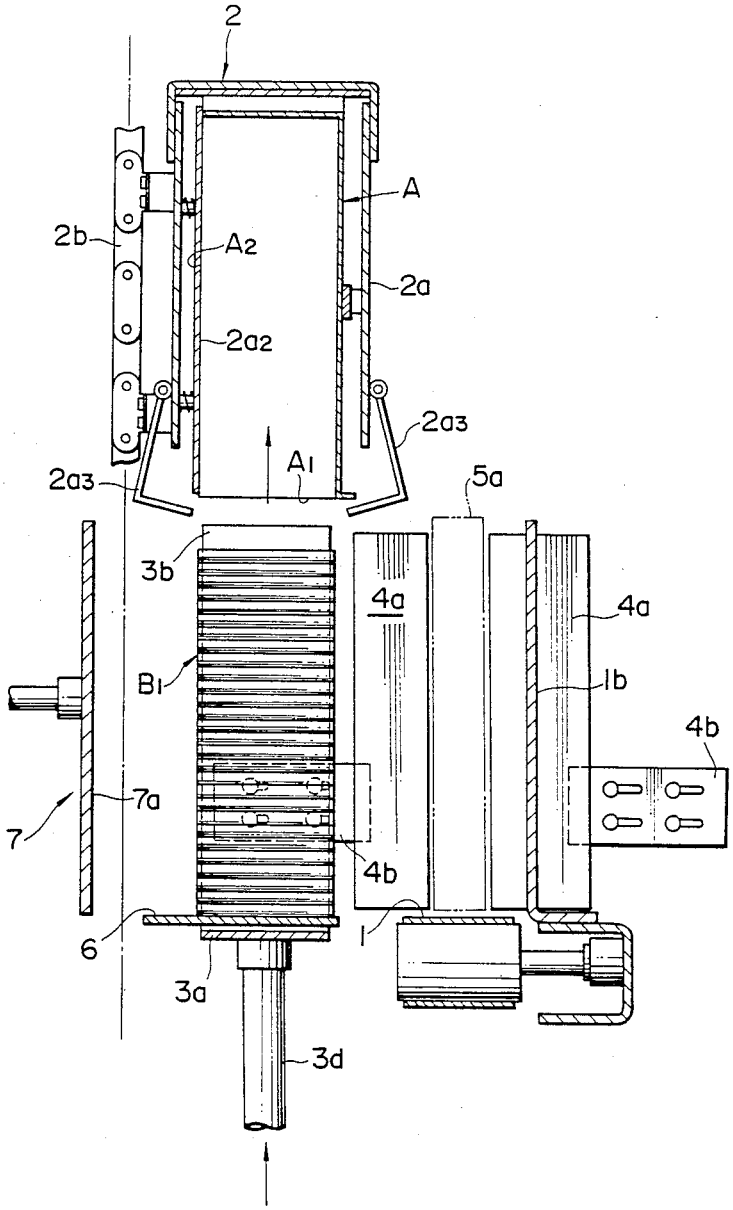
Figure 8:
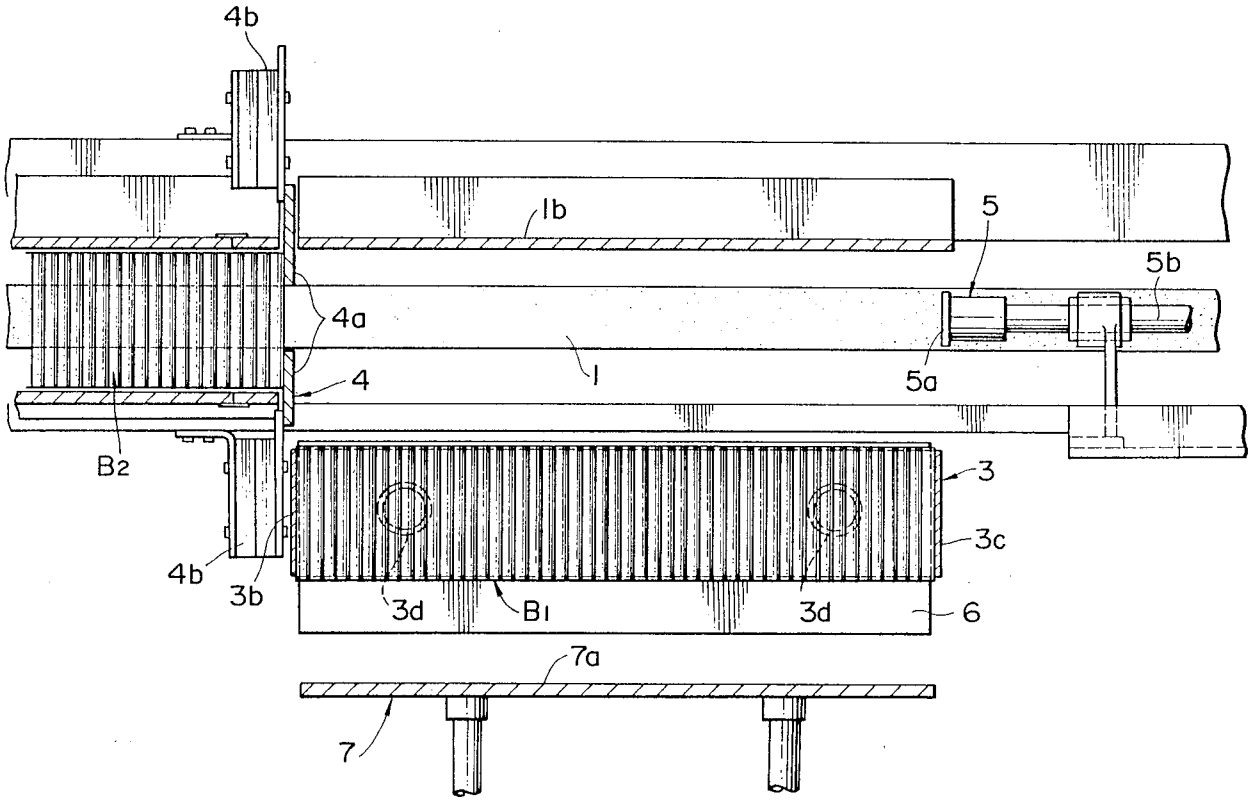
Figure 9:
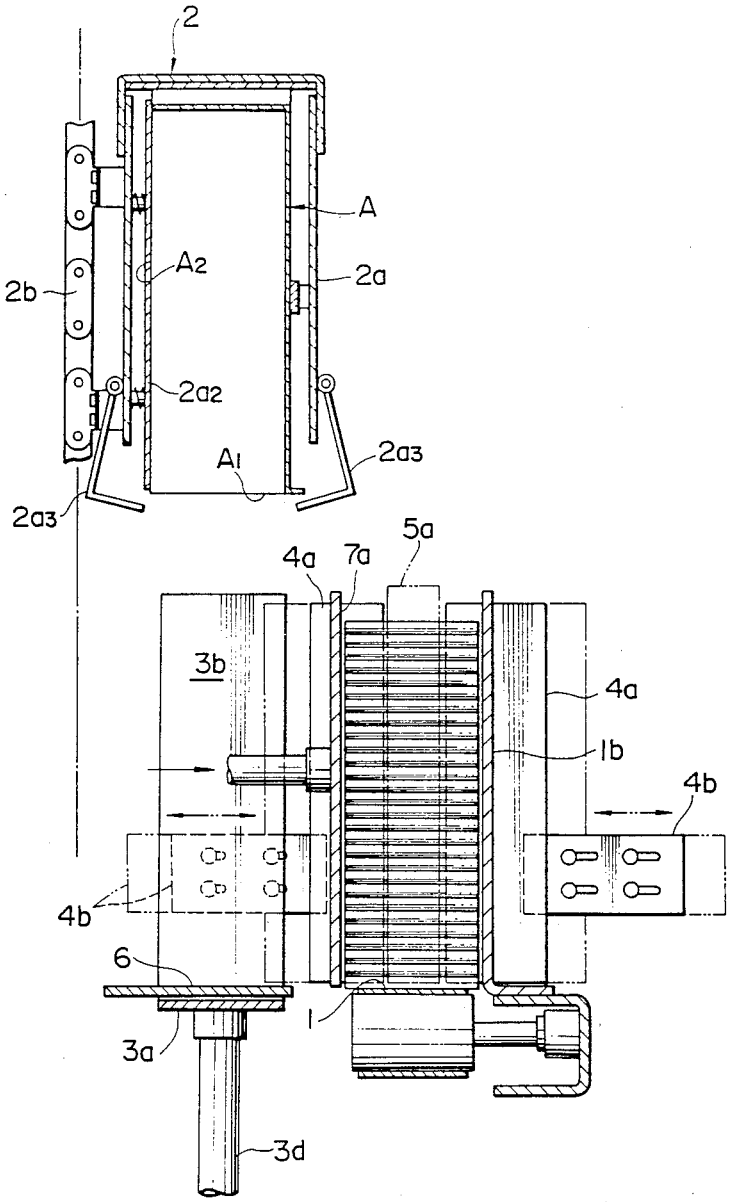
Figure 10:
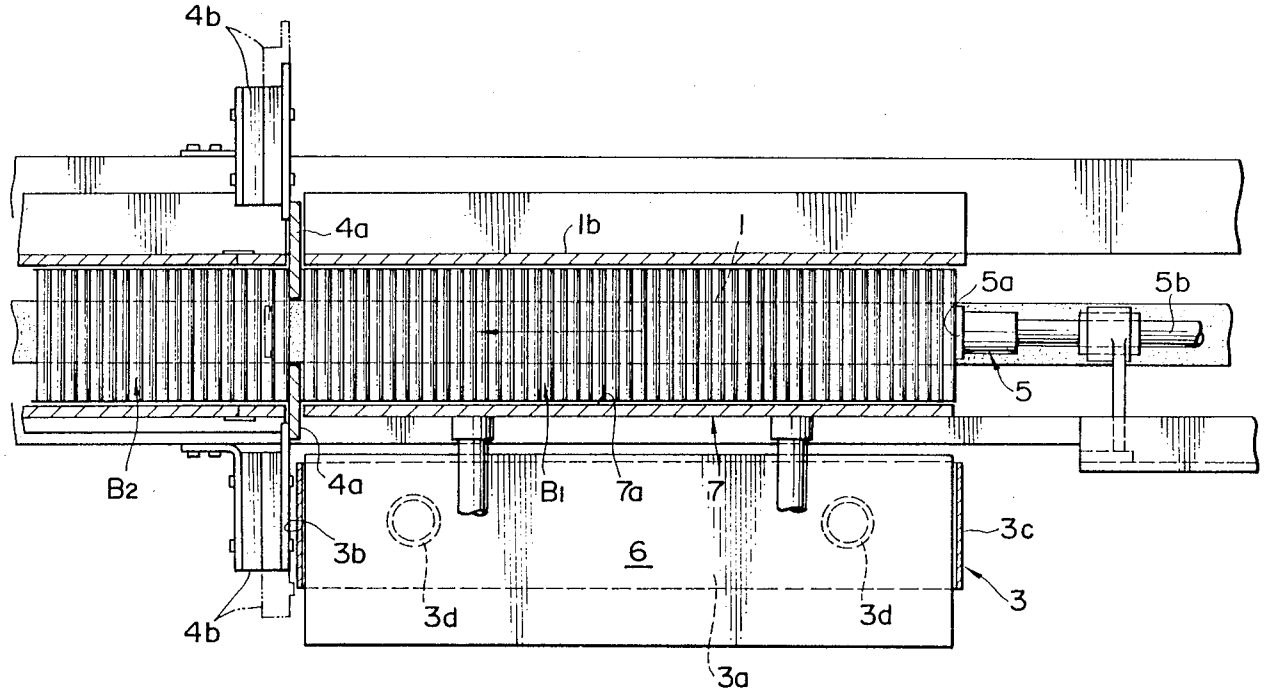

As the opening or closing lids $2a_3$, $2a_3$ are opened, the rod-like articles B in the storing box A are transported through the opening $A_1$, now located beneath the rod-like articles, onto the upper surface of the two belt conveyors constituting the supplying passage 1. Thereafter, the empty storing box A is lifted, together with the reversing frame 2a of the box distributing mechanism 2, under operation of the conveyor chains 2b, 2b, back to the feeding, or receiving, position. However, as the empty storing box A starts to rise under the operation of the box distributing mechanism 2, the forward and rearward partition plates 3b and 3c, 3c simultaneously begin to rise under operation of the air cylinder 3d in a substantially vertical direction to contain the group of rod-like articles B in its aforementioned predetermined configuration. At this time, side walls 1a, 1a, as shown in FIGS. 4 and 5, which extend along the longitudinal axis of the supplying passage 1, and provide vertical walls extending from the shutter plates 4a, 4a to partition 3, move toward each other to retain the rod-like articles longitudinally.

During this time, the group $B_1$ of rod-like articles on the supplying passage 1 tend to move from the predetermined configuration at its forward and rearward ends as the storing box A is lifted. However, it is guided again by the forward and rearward partition plates 3b and 3c, 3c, so that its predetermined configuration is substantially the same as when it is stored in the storing box A. As the driven member 3a, shown in FIGS. 2 and 3, reaches its upper limit position, the group of rod-like articles $B_1$ from the discharge box are engaged and supported by the receiving surface $3a_1$ of the driven member 3a.

Then, as the driven member 3a completes its upward movement, it is advanced forwardly by the air cylinder 3e, cylinder 3e being used in performing a forward or a rearward movement. The forward surface of the front partition plate 3b thereby reaches an advanced position adjacent the right and left shutters 4a, 4a which are kept closed as much as possible. Preferably, partition plate 3b advances to a position between both plates 4a, 4a and stopped, as shown in FIG. 5. After it is confirmed that the forward movement of the driven member 3a and the front end surface of the group of rod-like articles $B_1$ has reached the rear surfaces of the right and left shutter plates 4a, 4a, the lateral feeding plate 5a of the lateral feeding pusher mechanism 5 is advanced between the right and left rearward partition plates 3c, 3c and then is stopped when the front end surface abuts against the rear end surface of the group of rod-like articles $B_1$. The partition mechanism 3, shutter mechanism 4, and feeding mechanism, together with side plates 4a, 5 thus effectively act as a containing mechanism for containing the articles on conveyor 1 substantially in the same configuration as that in which the articles are maintained in storing container A.

After the advancement of the lateral feeding plate 5a is stopped, the driven member 3a and the forward or rearward partition plates 3b and 3c, 3c are moved in a downward direction, thereby the group of rod-like articles $B_1$ on the receiving surface $3a_1$ is placed again onto the two belt conveyors constituting the supplying passage 1. The front end surfaces of the group are supported by the right and left shutter plates 4a, 4a, its rear end surfaces are supported by the lateral feeding plate 5a, respectively, and its predetermined configuration remains substantially unchanged.

When the driven member 3a and the forward or rearward partition plates 3b and 3c, 3c reach their lower limit positions, they are retracted back to their original positions and, at substantially the same time, the right and left shutter plates 4a, 4a are opened so as to connect the rear end surfaces of the group of the rod-like articles $B_2$ already transported in the supplying direction through the shutter plates 4a, 4a, into the storing device C with the group of rod-like articles $B_1$ positioned rearward of the shutter plates 4a, 4a. Therefore, it can readily be appreciated that the thicknesses of the right and left shutter plates 4a, 4a and the forward partition plate 3b positioned between these groups $B_1$ and $B_2$ of the rod-like articles should preferably be as small as possible to thereby most efficiently transfer sequentially transferred groups toward the storing device C while maintaining the groups in their predetermined configurations.

Thereafter, the lateral feeding plate 5a of the lateral feeding pusher mechanism 5 and the two belt conveyors constituting the supplying passage 1 in the preferred embodiment are advanced at substantially the same speed to cause the groups $B_1$ and $B_2$ of the rod-like articles to be moved laterally, pass between the right and left shutter plates 4a, 4a, and then transported and fed into the device together at the inlet end of the storing device C.

At the movement the lateral feeding plate 5a passes between the right and left shutter plates 4a, 4a and slightly enters the storing device C, the right and left shutter plates 4a, 4a are closed. Thereafter, only the lateral feeding plate 5a is retracted, passing between the closed right and left shutter plates 4a, 4a, and then is returned to its original position.

When the lateral feeding plate 5a is returned, as described above, the two belt conveyors constituting the supplying passage 1 remain stopped and the transported groups $B_1$ and $B_2$ of the rod-like articles are not moved.

The empty storing box A returned to the feeding position of the box distributing mechanism 2 is pulled onto the carriage D by means of engaging claw $E_4$ engaging with hook element $A_3$ of the storing box A. The storing box A is then discharged by being moved out of alignment with pusher $E_1$ of the transporting mechanism E by movement of carriage D, or by means of a device located on carriage D for exchanging a filled storage box A for the empty one. Thus, the subsequent storing box A, in which a further group of rod-like articles B is stored, is transported to the feeding position with the transporting mechanism E, and the operation as described above will be repeated for this subsequent storing box.

The second embodiment of the invention, as illustrated in FIGS. 6 through 10, is constructed such that the shutter mechanism 4 and the lateral feeding pusher mechanism 5 are arranged on the supplying passage which is preferably constituted by one endless belt conveyor, and a transporting and receiving surface 6 is arranged substantially parallel with the supplying passage 1 or substantially flush with or slightly higher than the upper surface of the belt conveyor. Further, the storing box A is inverted over the transporting and receiving surface 6 by means of the box distributing mechanism 2. A partition mechanism 3 is installed below the transporting and receiving surface 6, and a pushing mechanism 7 is arranged along the side of the supplying direction substantially perpendicular thereto.

The partition mechanism 3 is operated such that the belt-like forward and rearward partition plates **3*b* and 3*c* are placed at the forward and rearward portions of the plate-like driven member 3*a* laterally installed below the transporting and receiving surface 6 in such a way that each of the forward and rearward inner surfaces is substantially flush with the rear surfaces of the right and left shutter plates 4*a*, 4*a* of the shutter mechanism 4, or the front surface of the lateral feeding plate 5*a* of the lateral feeding pusher mechanism 5, in a direction substantially perpendicular to the supplying direction and, at the same time, the air cylinder 3*d* for use in performing a vertical movement is cooperatively arranged below the driven member 3*a*. At the lower limit position of the driven member 3*a* having the rod of the air cylinder moved downwardly, the upper ends of the forward and rearward partition plates 3*b* and 3*c* are positioned below the transporting and receiving surface 6. At the upper limit position having the rod extended upwardly, the upper ends of the forward and rearward partition plates 3*b* and 3*c* are positioned below the transporting and receiving surface 6. At the upper limit position in which the rod is extended upwardly, only the forward and rearward partition plates 3*b* and 3*c* are projected upwardly from the transporting and receiving surface 6, and each of the upper ends is substantially flush with or slightly higher than the height of the group $B_1$ of the rod-like articles supplied onto the transporting and receiving surface 6**.

The pusher mechanism 7 is made such that it is composed of a pusher plate **7*a* having a width in the supplying direction slightly less than an inner width between the forward and rearward partition plates 3*b* and 3*c*, and a height substantially the same as or slightly greater than the height of the group $B_1$ of rod-like articles to be supplied from a slightly higher position than the transporting and receiving surface 6. The pusher mechanism 7 further includes a lateral moving means such as an air cylinder for reciprocating the pusher plate 7*a* in a direction substantially perpendicular to the supplying direction by a predetermined amount. The outermost position of the pusher plate 7*a*, through the driving of the above-mentioned means, is at a location where the movement of the reversing frame 2*a* of the box distributing mechanism is not hindered. At the innermost position of pusher plate 7*a*, a spacing slightly greater than the length of the rod-like articles B is provided between the vertically arranged side wall plate 1*b* along one side of the supplying passage 1 and pusher plate 7*a*. It is contemplated that wall plate 1*b* could, if desired, be mounted for movement by an air cylinder, e.g., in conjunction with plate 7*a*, to effectively contain the rod-like articles substantially in the predetermined configuration they were in prior to discharge form storing box A. That is, prior to discharge, plate 1*b* would be positioned along an opposite side of receiving surface 6 from plate 7*a* and would be retracted across conveyor 1 as plate 7*a* is extended toward conveyor 1** at substantially the same speed.

The sequential operation of the second embodiment of the invention, described above, will now be explained.

First, similarly to the above-mentioned first embodiment the storing box A is loaded within and inverted by the box distributing mechanism 2. After the storing box A is thus inverted and transported onto the transporting and receiving surface 6, the opening and closing lids $2a_3$, $2a_3$ are opened. The box is then raised and returned to the feeding position by the box distributing mechanism 2, resulting in that simultaneous with this operation, the forward and rearward partition plates **3*b* and 3*c* are lifted to cause the group $B_1$ of the rod-like articles within the storing box A to be supported between the forward and rearward partition plates 3*b* and 3*c***, without substantially varying their predetermined configuration.

Upon confirmation of the completion of the upward movement of the forward and rearward partition plates **3*b* and 3*c*, the pusher plate 7*a* of the pushing pusher mechanism 7 is moved toward the supplying passage 1 and fitted between the forward and rearward partition plates 3*b* and 3*c*, and the group $B_1$ of the rod-like articles of one box on the transporting and receiving surface 6 are thereby pushed onto the supplying passage 1. If desired, as mentioned above, side wall plate 1*b* could be moved to engage an opposite side of the group $B_1$ of rod-like articles and thereafter be retracted as pusher plate 7*a*** is extended to thereby maintain the group in its predetermined configuration.

At this time, the group $B_1$ of rod-like articles is moved such that its front end surface is moved from the rear surface of the forward partition plate **3*b* to the rear surfaces of the right and left shutter plates 4*a*, 4*a*, and its rear end surface is moved from the front surface of the rearward partition plate 3*c* to the front surface of the lateral transporting plate 5*a*. Since it is guided by these elements, the piled-up condition of the group $B_1$ of rod-like articles is not substantially varied. When the pusher plate 7*a* reaches its inner limit position, however, the group $B_1$ of rod-like articles is completely transferred from the transporting and receiving surface 6 onto the supplying passage 1**.

After it is confirmed that the movement of the pusher plate **7*a* is completed, the right and left shutter plates 4*a*, 4*a* are opened in the same manner as that of the first embodiment, while the pusher plate 7*a* is maintained at the innermost position to cause the rod-like articles $B_2$ in the storing device C to be connected with the rod-like articles $B_1$ positioned rearwardly of the plates 4*a*, 4*a*. Thereafter, the groups $B_1$ and $B_2$ of rod-like articles are laterally moved by the belt conveyor and the lateral feeding plate 5*a* of the supplying passage 1 and transported and supplied into the storing device C. The right and left shutter plates 4*a*, 4*a* are then closed and each of the lateral feeding plate 5*a*, pusher plate 7*a*, and the forward and rearward partition plates 3*b* and 3*c*** are returned to their original positions.

The present invention, as described above, has the following advantages. The rod-like article storing box is transported from the feeding, or receiving, position by the box distributing mechanism to its inverted condition and held at the supplying passage or at the transporting and receiving surface in its inverted form. Thereafter, the storing box is raised and returned to the feeding position and, at substantially the same time, the forward and rearward partition plates are raised in cooperation with the raising of the storing box. Thereby, the group of rod-like articles within the box is supported on the supplying passage or on the discharging and receiving surface without substantially varying their predetermined configuration. The forward and rearward partition plates are laterally moved in a forward direction, and the lateral feeding pusher is advanced or, alternatively, the front end surface of the group of rod-like articles approaches the shutter plate under a pushing operation across the supplying direction by the pusher, and the rear end surface of the group of rod-like articles approaches the lateral feeding pusher. Thereby, the group of rod-like articles is supported between the shutter plates and the lateral feeding pusher while being maintained in said predetermined configuration. Then the forward and rearward partition plates descend to cause them to be fed in together or directly fed in with the lateral feeding pusher, so that any type of storing box can be used without regard to the presence or absence of any projections at its outer side surface. Since the empty box is returned, it is not necessary to install an empty box discharging mechanism. Accordingly, the device can be simplified and the entire device can be made relatively small in size.

Although the invention has been disclosed as utilizing particular means, elements, and structural details, the invention is not to be limited thereto, but extends to all equivalents embraced by the claims as set forth below. For example, in both of the above-described embodiments, although the rod-like article supplying passage 1 is composed of a belt conveyor, it is apparent that it is not limited thereto. For example, a flat plate-like fixing plate, or spaced plates for receiving the partition mechanism therebetween, may also be installed. Further, the rod-like material storing box A is not limited to the embodiment illustrated, i.e., having a hook element $A_3$ at an outer side surface. For example, the rod-like article storing box could have no projection at its outer side surface, and further, the pusher $E_1$ of the transporting mechanism E can be modified in design. In addition, it is contemplated that the transporting mechanism E can be eliminated so that the storing boxes are directly and manually fed into the transporting position of the box distributing mechanism 2 and, further, the vacant storing boxes can be directly and manually transported therefrom.

What is claimed is:

1. A method for conveying rod-like articles comprising: containing a group of said rod-like articles in a predetermined configuration in a storing box having an open top surface, inverting said storing box and moving said storing box in said inverted position in a substantially vertical direction to a supplying passage which communicates with a storing device through a shutter plate, which can be opened or closed across said supplying passage, raising a front and rear partition plate simultaneously with raising said storing box to thereby support said group of rod-like articles from said box without substantially varying said predetermined configuration, thereafter moving said front and rear partition plates in a forward supplying direction by a desired and predetermined distance to cause a front end surface of said group of rod-like articles to become substantially adjacent said shutter plate, advancing a pusher by a desired and predetermined distance to a position proximate a rear end surface of said group of rod-like articles, thereafter lowering said front and rear partition plates simultaneously with opening said shutter plate to cause said group of rod-like articles on said supplying passage to be moved in a direction substantially perpendicular to a longitudinal direction in which said group of rod-like articles extend, thereby transporting said rod-like articles into said storing device.

2. An apparatus for conveying rod-like articles comprising:

a supply passage along which said articles are transported in a predetermined direction by means of a supply conveyor;

a container distributing mechanism for holding a container for containing articles in a predetermined configuration, said configuration having a forward end and a rearward end, said configuration determined by the interior dimensions of said container, said container distributing mechanism further comprising an inverting device attached to a transporting device for moving said container between a feeding position and a discharging position adjacent a supply conveyor, said container being inverted in said discharging position; and a containing mechanism having predetermined dimensions for containing said articles in said predetermined configuration at said discharging position and for permitting said container to be returned to said feeding position, and containing mechanism comprising a lateral feeding mechanism located adjacent said supply conveyor upstream of said rearward end of said configuration in said predetermined direction of movement of said supply conveyor for moving said articles in said predetermined direction of movement of said supply conveyor, wherein said rod-like articles have a predetermined length and said lateral feeding mechanism comprises a lateral feeding plate for engaging said rearward end of said configuration of said rod-like articles, having a width transverse to said predetermined direction of said supply passage less than the length of one of said rod-like articles.

3. The apparatus of claim 2 further comprising a transporting mechanism for moving containers into said feeding position.

4. The apparatus of claim 3 wherein said transporting mechanism comprises a pusher for pushing said containers into said feeding position.

5. The apparatus of claim 4 wherein said transporting mechanism further comprises an engaging claw mounted for movement on said pusher for engagement with and disengagement from a hook element of said container.

6. The apparatus of claim 2 wherein said inverting device comprises an upwardly facing open side in said feeding position, and a selectively actuable lid extending over at least a portion of said open side.

7. The apparatus of claim 6 wherein said transporting device is configured to move said inverting device sequentially from said feeding; position upwardly to an upper extreme position and downwardly therefrom, such that said open side is downwardly facing, to said discharging position.

8. The apparatus of claim 2 further comprising a shutter mechanism located along said supply passage downstream of said forward end of said predetermined configuration in said predetermined direction of said supply and an open position at which position said articles are permitted to move along said supply passage.

9. The apparatus of claim 8 wherein said shutter mechanism comprises a shutter plate mounted on either side of said supply conveyor for reciprocation between a closed position in which said shutter plates are spaced apart a distance less than the length of one said rod-like articles and an open position in which said shutter plates are spaced apart a distance greater than the length of one of said rod-like articles.

10. The apparatus of claim 2 wherein said supply passage comprises a plurality of side-by-side conveying elements, at least two of which are spaced apart a predetermined amount, wherein said containing mechanism comprises a partition mechanism which includes an upwardly projecting forward partition member for engaging a downstream end of said predetermined configuration of articles, an upwardly projecting rearward partition member for engaging an upstream end of said predetermined configuration of articles, and a laterally extending driven member having an upper support surface for said rod-like articles, said driven member connecting said forward partition member and said rearward partition member at respective lower ends of said partition members, said partition mechanism being operable to move between a retracted position beneath an upper surface of said supply passage to a support position wherein said forward partition member, said rearward partition member, and said upper support surface of said driven member are extended between two of said plurality of side-by-side conveying elements to contain said rod-like articles in substantially said predetermined configuration.

11. The apparatus of claim 10 wherein said partition mechanism is operable to move said rod-like articles in substantially said predetermined configuration in substantially said predetermined direction of said supply passage.

12. The apparatus of claim 11 further comprising a shutter mechanism located along said supply passage downstream of said forward end of said predetermined configuration in said predetermined direction of said supply passage, in said discharge position, wherein said partition mechanism is operable to move said rod-like articles to a position substantially adjacent said shutter mechanism, whereby said shutter mechanism blocks movement of said rod-like articles in said predetermined direction of said supply passage.

13. The apparatus of claim 12 wherein said conveying elements are driven for movement, and wherein said shutter mechanism is movable between a blocking position and an open position, and wherein in said open position said feeding mechanism and said conveying elements move substantially at the same speed in said predetermined direction to advance said rod-like articles from said discharge position.

14. The apparatus of claim 13, further comprising a storage device communicating with said supply passage downstream of said discharging position of said rod-like articles such that said rod-like articles are advanced toward said storage device.

15. The apparatus of claim 10 wherein said rearward partition member comprises a pair of rearward partition plates spaced apart a distance greater than said width of said lateral feeding plate to permit said lateral feeding plate to extend between said pair of rearward partition plates to engage said rearward end of said predetermined configuration of articles.

16. The apparatus of claim 2 further comprising a relatively stationary receiving surface for receiving said articles in said predetermined configuration at said discharging position, and a transfer mechanism for transferring said articles in said predetermined configuration to said supply passage.

17. The apparatus of claim 16 wherein said supply passage has an upper support surface and wherein said receiving surface is substantially flush with said upper support surface, and wherein said transfer mechanism comprises a pushing mechanism for pushing said articles in said predetermined configuration across said receiving surface onto said upper support surface of said supply passage.

18. The apparatus of claim 17 wherein said pushing mechanism comprises a pusher plate mounted for movement across said receiving surface as said articles are pushed across said receiving surface to a position along side of said supply passage to thereby function as a guide as said articles in said predetermined configuration are moved along said supply passage in said predetermined direction, and further comprising a side wall plate positioned along an opposite side of said supply passage from said pusher plate.

19. The apparatus of claim 18 wherein said side wall plate is mounted or movement in conjunction with and at substantially the same speed as said pusher plate of said transfer mechanism to maintain a spacing therebetween slightly wider than the length of one of said articles to maintain said articles in said predetermined configuration during transfer.

20. An apparatus for conveying articles comprising:

a supply passage along which said articles are transported in a predetermined direction by means of a supply conveyor;

a container distributing mechanism for holding a container for containing articles in a predetermined configuration, said configuration having a forward end and a rearward end, said configuration determined by the interior dimensions of said container, said container distributing mechanism further comprising an inverting device attached to a transporting device for moving said container between a feeding position and a discharging position adjacent said supply passage, said container being inverted in said discharging position; and a containing mechanism having predetermined dimensions for containing said articles in said predetermined configuration at said discharging position and for permitting said container to be returned to said feeding position, said containing mechanism comprising a partition mechanism including forward and rearward partition plates for containing said articles against substantial downstream and upstream movement, respectively, with regard to said supply passage, a lateral feeding mechanism located adjacent said supply conveyor upstream of said rearward end of said configuration in said predetermined direction of movement of said supply conveyor for moving said articles in said predetermined direction of movement of said supply conveyor.

21. The apparatus of claim 20 further comprising a driven member connecting said forward and rearward partition plates and adapted to support said articles discharged at said discharging position.

22. The apparatus of claim 21 wherein said driven member comprises a receiving surface for supporting said articles and movable between a supporting position slightly above an upper surface of said supply conveyor and a retracted position in which said forward and rearward partition plates are below said upper surface of said supply conveyor.

23. The apparatus of claim 22 further comprising a first drive apparatus operatively associated with said driven member to move said driven member in a substantially vertical direction between said supporting position and said retracted position.

24. The apparatus of claim 23 further comprising a second drive apparatus operatively associated with said driven member to move said driven member substantially in said predetermined direction of said supply passage from a receiving position to an advanced position proximate said forward partition plate of said partition mechanism.

25. The apparatus of claim 20 wherein said containing mechanism further comprises at least one selectively movable side plate positioned along side said supply passage.

26. The apparatus of claim 20 wherein said containing mechanism further comprises a selectively movable side plate positioned on either side of said supply passage.

27. The apparatus of claim 20 further comprising a transporting mechanism for moving containers into said feeding position.

28. The apparatus of claim 27 wherein said transporting mechanism comprises a pusher for pushing said containers into said feeding position.

29. The apparatus of claim 20 wherein said inverting device comprises an upwardly facing open side in said feeding position, and a selectively actuable lid extending over at least a portion of said open side.

30. The apparatus of claim 29 wherein said transporting device is configured to move said inverting device sequentially from said feeding position upwardly to an upper extreme position and downwardly therefrom, such that said open side is downwardly facing, to said discharging position.

31. The apparatus of claim 20 further comprising a shutter mechanism located along said supply passage downstream of said forward end of said predetermined configuration in said predetermined direction of said supply passage, in said discharging position, for blocking advancement of said articles along said supply passage.

32. The apparatus of claim 20 further comprising a relatively stationary receiving surface for receiving said articles in said predetermined configuration at said discharging position, and a transfer mechanism for transferring said articles in said predetermined configuration to said supply passage.

33. An apparatus for conveying articles comprising:

a supply passage along which said articles are transported in a predetermined direction including a supply conveyor, a drive apparatus for driving said supply conveyor, a drive apparatus for driving said lateral feeding mechanism, and a drive apparatus for driving said supply conveyor and said lateral feeding mechanism at substantially the same speed, wherein said drive apparatus for said lateral feeding mechanism and said drive apparatus for said supply conveyor share a common drive motor, wherein said drive apparatus for said supply conveyor includes a clutch to stop movement of said supply conveyor during predetermined times;

a container distributing mechanism for holding a container for containing articles in a predetermined configuration, said configuration having a forward end and a rearward end, said configuration determined by the interior dimensions of said container, said container distributing mechanism further comprising an inverting device attached to a transporting device for moving said container between a feeding position and a discharging position adjacent said supply conveyor, said container being inverted in said discharging position; and a containing mechanism having predetermined dimensions for containing said articles in said predetermined configuration at said discharge position and for permitting said container to be returned to said feeding position, said containing mechanism comprising a lateral feeding mechanism located adjacent said supply conveyor upstream of said rearward end of said configuration in said predetermined direction of movement of said supply conveyor for moving said articles in said predetermined direction of movement of said supply conveyor.

34. The apparatus of claim 33 wherein said lateral feeding mechanism comprises a reciprocal member for advancing said articles in the direction of movement of said supply conveyor and wherein said predetermined times at which said clutch stops movement of said supply conveyor occur during retraction of said reciprocal member in a direction substantially opposite to the direction of movement of said supply conveyor.

35. The apparatus of claim 33 further comprising a transporting mechanism for moving containers into said feeding position.

36. The apparatus of claim 35 wherein said transporting mechanism comprises a pusher for pushing said containers into said feeding position.

37. The apparatus of claim 33 wherein said inverting device comprises an upwardly open side in said feeding position, and a selectively actuable lid extending over at least a portion of said open side.

38. The apparatus of claim 37 wherein said transporting device is configured to move said inverting device sequentially from said feeding position upwardly to an upper extreme position and downwardly therefrom, such that said open side is downwardly facing, to said discharging position.

39. The apparatus of claim 33 further comprising a shutter mechanism located along said supply passage downstream of said forward end of said predetermined configuration in said predetermined direction of said supply passage, in said discharging position, for blocking advancement of said articles along said supply passage.

40. The apparatus of claim 33 further comprising a relatively stationary receiving surface for receiving said articles in said predetermined configuration at said discharging position, and a transfer mechanism for transferring said articles in said predetermined configuration to said supply passage.

41. An apparatus for conveying articles wherein each of said articles has a substantially equal predetermined length, wherein a group of articles in said predetermined configuration has a forward end and a rearward end and a predetermined length between said forward end and said rearward end, a predetermined height, and a predetermined width, said predetermined width defined by said predetermined length of said articles, said apparatus comprising:

(a) a supply passage along which said articles are conveyed in a first direction, wherein said supply passage further comprises a plurality of side-by-side spaced apart support surfaces;

(b) means for (i) receiving said group of said articles in a predetermined configuration in a storage container, said container having an upwardly facing opening, (ii) moving said group of articles in said predetermined configuration in said storage container from a receiving position to a discharging position, said discharging position being proximate said supply passage, and (iii) discharging said group of articles in said predetermined configuration from said storage container at said discharging position, wherein said means for (i) receiving, (ii) moving, and (iii) discharging further comprises means for (iv) inverting said storage container to thereby direct said upwardly facing opening downwardly and for (v) releasing said group of articles from said storage container and withdrawing said storage container from said discharging position in a predetermined direction; and (c) means for containing said group of articles substantially in said predetermined configuration as said group of articles is discharged, comprising a forward member for containing said forward end of said group of articles and a rearward member for containing said rearward end of said group of articles, wherein said group of articles are discrete and loose in said predetermined configuration at said discharge position, and wherein solely said containing means contains said group of article sin said predetermined configuration, wherein said forward member and said rearward member of said containing means are mounted for movement from below said support surface to above said support surface, wherein said containing means further comprises means for moving said articles in said first direction, and wherein said forward member and said rearward member of said containing means are arranged for movement between a pair of said support surfaces; and (d) means for moving said forward member and said rearward member of said containing means in said predetermined direction in which said storage container is withdrawn as said storage container is withdrawn, said predetermined direction in which said container is withdrawn being substantially upward.

42. The apparatus of claim 41 wherein said articles are rod-like articles each having longitudinal axes and wherein, in said predetermined configuration, said longitudinal axes are substantially parallel to each other, and wherein said containing means substantially prevents said rod-like articles from rolling relative to one another.

43. The apparatus of claim 41 further comprising a receiving surface for receiving said group of articles at said discharging position, wherein said forward member and said rearward member of said containing means are movable upwardly to contain said group of articles in said predetermined configuration on said receiving surface.

44. The apparatus of claim 43 further comprising means for transferring said group of articles in said predetermined configuration from said receiving surface to said supply passage.

45. The apparatus of claim 41 further comprising means for blocking movement of said articles along said supply passage, mounted for movement between a blocking position and an open position at which position said articles are permitted to move along said supply passage.

46. An apparatus for conveying articles wherein each of said articles has a substantially equal predetermined length, wherein a group of articles in said predetermined configuration has a forward end and a rearward end and a predetermined length between said forward end and said rearward end, a predetermined height, and a predetermined width, said predetermined width defined by said predetermined length of said articles, said apparatus comprising:

(a) a supply passage provided with a means of conveying, comprising a pusher, for exerting a force against said group of articles along said supply passage in a first direction, wherein said means for conveying further comprises a powered conveyor supporting said articles from below;

(b) means for (i) receiving said group of said articles in a predetermined configuration in a storage container, said container having an upwardly facing opening, (ii) moving said group of articles in said predetermined configuration in said storage container from a receiving position to a discharging position, said discharging position being proximate said supply passage, and (iii) discharging said group of articles in said predetermined configuration from said storage container at said discharging position, wherein said means for (i) receiving, (ii) moving, and (iii) discharging further comprises means for (iv) inverting said storage container to thereby direct said upwardly facing opening downwardly and for (v) releasing said group of articles from said storage container and withdrawing said storage container from said discharging position in a predetermined direction; and (c) means for containing said group of articles substantially in said predetermined configuration as said group of articles is discharged, comprising a forward member for containing said forward end of said group of articles and a rearward member for containing said rearward end of said group of articles, wherein said group of articles are discrete and loose in said predetermined configuration at said discharge position, and wherein solely said containing means contains said group of articles in said predetermined configuration; and (d) means for moving said forward member and said rearward member of said containing means in said predetermined direction in which said storage container is withdrawn as said storage container is withdrawn, said predetermined direction in which said container is withdrawn being substantially upward.

47. The apparatus of claim 46 wherein said articles are rod-like articles each having longitudinal axes and wherein, in said predetermined configuration, said longitudinal axes are substantially parallel to each other, and wherein said containing means substantially prevents said rod-like articles from rolling relative to one another.

48. The apparatus of claim 46 further comprising means for blocking movement of said articles along said supply passage, mounted for movement between a blocking position and an open position at which position said articles are permitted to move along said supply passage.

49. The apparatus of claim 46 further comprising a receiving surface for receiving said group of articles at said discharging position, wherein said forward member and said rearward member of said containing means are movable upwardly to contain said group of articles in said predetermined configuration on said receiving surface.

50. The apparatus of claim 49 further comprising means for transferring said group of articles in said predetermined configuration from said receiving surface to said supply passage.

51. An apparatus for conveying articles wherein each of said articles has a substantially equal predetermined length, wherein a group of articles in said predetermined configuration has a forward end and a rearward end and a predetermined length between said forward end and said rearward end, a predetermined height, and a predetermined width, said predetermined width defined by said predetermined length of said articles, said apparatus comprising:

(a) a supply passage with a support surface, said supply passage provided with a means of conveying, comprised of a pusher, for exerting a force against said group of articles to convey said group of articles across said support surface in a first direction;

(b) means for (i) receiving said group of said articles in a predetermined configuration in a storage container, said container having an upwardly facing opening, (ii) moving said group of articles in said predetermined configuration in said storage container from a receiving position to a discharging position, said discharging position being proximate said supply passage, and (iii) discharging said group of articles in said predetermined configuration from said storage container at said discharging position, wherein said means for (i) receiving, (ii) moving, and (iii) discharging further comprises means for (iv) inverting said storage container to thereby direct said upwardly facing opening downwardly and for (v) releasing said group of articles from said storage container and withdrawing said storage container from said discharging position in a predetermined direction; and (c) means for containing said group of articles substantially in said predetermined configuration as said group of articles is discharged, comprising a forward member for containing said forward end of said group of articles and a rearward member for containing said rearward end of said group of articles, wherein said group of articles are discrete and loose in said predetermined configuration at said discharge position, and wherein solely said containing means contains said group of articles in said predetermined configuration; and (d) means for moving said forward member and said rearward member of said containing means in said predetermined direction in which said storage container is withdrawn as said storage container is withdrawn, said predetermined direction in which said container is withdrawn being substantially upward.

52. The apparatus of claim 51 wherein said articles are rod-like articles each having longitudinal axes and wherein, in said predetermined configuration, said longitudinal axes are substantially parallel to each other, and wherein said containing means substantially prevents said rod-like articles from rolling relative to one another.

53. The apparatus of claim 51 further comprising means for blocking movement of said articles along said supply passage, mounted for movement between a blocking position and an open position at which position said articles are permitted to move along said supply passage.

54. The apparatus of claim 51 further comprising a receiving surface for receiving said group of articles at said discharging position, wherein said forward member and said rearward member of said containing means are movable upwardly to contain said group of articles in said predetermined configuration on said receiving surface.

55. The apparatus of claim 54 further comprising means for transferring said group of articles in said predetermined configuration from said receiving surface to said supply passage.

56. A method of conveying rod-like articles having substantially uniform lengths comprising:

(a) receiving a group of said articles in a predetermined configuration in a storage container at a receiving location;

(b) moving said group of articles in said predetermined configuration in said storage container by inverting said storage container between said receiving location to a discharging location proximate a supply passage;

(c) discharging said group of articles from said storage container by raising said inverted storage container from said discharging location to thereby empty said storage container at said discharging location;

(d) containing said group of articles substantially in said predetermined configuration as said group of articles is discharged from said storage container, comprising raising a pair of partition members which are spaced apart by a distance substantially equal to a distance between a pair of inner walls of said storage container;

(e) conveying said group of articles in a direction along said supply passage while substantially maintaining said group of articles in said predetermined configuration; and (f) advancing said group of articles along said supply passage by means of said partition members to a predetermined location, blocking further advancing of said group of articles by means of a shutter mechanism, and retracting said partition members from said supply passage.

57. The method of claim 56 wherein said predetermined configuration of said group of articles includes a predetermined width in said direction of said supply passage, wherein said articles are loose within said container, and wherein said step of containing comprises maintaining said predetermined width substantially constant.

58. The method of claim 57 wherein said articles are rod-like articles having substantially uniform lengths, wherein said step of conveying further comprises conveying said group of rod-like articles in a direction substantially perpendicular to said lengths of said rod-like articles.

59. The method of claim 56 further comprising the step of opening said shutter mechanism to permit further advancing of said group of articles beyond said shutter mechanism.

60. The method of claim 56 further comprising the step of returning said storage container, after discharging said group of articles therefrom, to said receiving location.

* * * * *